US009153882B2

(12) United States Patent
Sakai et al.

(10) Patent No.: US 9,153,882 B2
(45) Date of Patent: Oct. 6, 2015

(54) CONNECTOR HAVING A CYLINDRICAL SECTION WITH A CONTACT CONNECTED TO AN ELECTRICAL WIRE THEREIN

(75) Inventors: Ken Sakai, Tokyo (JP); Eiichiro Takemasa, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 13/327,956

(22) Filed: Dec. 16, 2011

(65) Prior Publication Data

US 2012/0156920 A1 Jun. 21, 2012

(30) Foreign Application Priority Data

Dec. 17, 2010 (JP) ..... 2010-281612

(51) Int. Cl.

| | |
|---|---|
| ***H01R 13/60*** | (2006.01) |
| ***H01R 4/48*** | (2006.01) |
| ***H01R 12/50*** | (2011.01) |
| ***H01R 13/24*** | (2006.01) |
| *F21V 19/00* | (2006.01) |
| *F21Y 101/02* | (2006.01) |

(52) U.S. Cl.

CPC ..... *H01R 4/4818* (2013.01); *H01R 13/2442* (2013.01); *H01R 23/7073* (2013.01); *F21V 19/0055* (2013.01); *F21Y 2101/02* (2013.01)

(58) Field of Classification Search

CPC ..... H01R 23/09; H01R 23/707

USPC ..... 439/490, 489, 541.5, 56, 441

See application file for complete search history.

(56) References Cited

U.S. PATENT DOCUMENTS

| | | | | |
|---|---|---|---|---|
| 5,399,103 | A * | 3/1995 | Kuboshima et al. | 439/509 |
| 6,093,053 | A * | 7/2000 | Horioka et al. | 439/444 |
| 6,174,194 | B1 * | 1/2001 | Bleicher et al. | 439/490 |
| 6,478,611 | B1 * | 11/2002 | Hyland | 439/490 |
| 6,485,338 | B1 * | 11/2002 | Wu | 439/862 |
| 6,699,065 | B1 * | 3/2004 | Espenshade et al. | 439/490 |
| 6,741,453 | B1 * | 5/2004 | Aleardi et al. | 361/640 |
| 7,204,711 | B2 * | 4/2007 | Garcia et al. | 439/336 |
| 7,309,252 | B2 * | 12/2007 | Fabian et al. | 439/404 |
| 7,828,557 | B2 * | 11/2010 | Vogt et al. | 439/56 |
| 8,007,310 | B2 | 8/2011 | Landis et al. | |
| 8,210,715 | B2 * | 7/2012 | Mostoller et al. | 362/249.02 |
| 8,241,044 | B2 * | 8/2012 | Mostoller et al. | 439/56 |
| 8,834,194 | B2 * | 9/2014 | Sakai | 439/345 |
| 2003/0236027 | A1 * | 12/2003 | Wang | 439/541.5 |
| 2008/0274641 | A1 * | 11/2008 | Weber et al. | 439/541.5 |
| 2013/0244480 | A1 * | 9/2013 | Wang et al. | 439/541.5 |

FOREIGN PATENT DOCUMENTS

JP 2009176733 A 8/2009

* cited by examiner

*Primary Examiner* — Chandrika Prasad
(74) *Attorney, Agent, or Firm* — Barley Snyder

(57) ABSTRACT

An LED connector assembly having a LED module, a base. and a connector. The LED module includes a substrate provided with a conductor pattern and an LED device disposed on a surface of the substrate and connecting to the conductor pattern. The base includes an attachment side larger than the LED module and attaching with the LED module such that a bottom surface of the LED module faces the attachment side. The connector that includes a housing fixed to the base, wherein the housing includes a cylindrical section with a conductor receiving passageway at a tip thereof to which the cylindrical section penetrates the base from the attachment side there through, and a contact having one end that connects to the conductor pattern and extend inside the cylindrical section for connection with an electrical wire insertable into the cylindrical section.

11 Claims, 6 Drawing Sheets

CONNECTOR HAVING A CYLINDRICAL SECTION WITH A CONTACT CONNECTED TO AN ELECTRICAL WIRE THEREIN

CROSS-REFERENCE TO RELATED APPLICATIONS

This application claims the benefit of the filing date under 35 U.S.C. §119(a)-(d) of Japanese Patent Application No. 2010-281612, filed Dec. 17, 2010.

FIELD OF THE INVENTION

The present invention relates to a connector assembly and, in particular, to a light emitting diode (LED) connector assembly incorporated in an LED lighting fixture.

BACKGROUND

Recently, lighting fixtures having LEDs, which have a lower power consumption and a longer life, have been used in place of known conventional incandescent lamps and lamps incorporating a fluorescent tube.

Among LED light fixtures, for example, there is one which has an external appearance similar to that of an incandescent lamp and may replace an incandescent lamp for use. A power conversion circuit to power the LED and an LED device are incorporated in such an LED lighting fixture.

As an example, Japanese Patent Application Publication No. 2009-176733 describes a configuration in which the substrate provided with the LED is placed on the lamp holding stage which functions as a heat dissipation plate, and the electrical wire to supply electric power to the LED is connected through the connection device. The connection device of Japanese Patent Application Publication No. 2009-176733 includes a so-called poke-in connector in which the electrical wire retaining lug is formed, and connected to the electrical wire end wherein the core is exposed, without soldering and crimping.

In the lamp holding stage shown in Japanese Patent Application Publication No. 2009-176733, the side in which the LED is arranged is a side of the light distribution face from which light is emitted, and the electrical wire is arranged close to the lamp holding stage so as not to interrupt light of the LED in the light distributing face. In addition, the connecting device is arranged so as to receive the electrical wire in the direction parallel to the surface of the electrical wire holding stage.

In assembling of the known lamp shown in Japanese Patent Application Publication No. 2009-176733, when the electrical wire is attached, the electrical wire is required to be held in the posture parallel to the surface at the position close to the electrical lamp holding stage and to be moved along the surface of the electrical lamp holding stage and inserted into the connection device. For these reasons, it is difficult to make the connection.

SUMMARY

The invention has been made in view of the above circumstances and provides an LED connector assembly and a connector which are efficient in connecting an electrical wire.

The invention provides an LED connector assembly having a LED module, a base and a connector. The LED module includes a substrate provided with a conductor pattern and an LED device disposed on a surface of the substrate and connecting to the conductor pattern. The base includes an attachment side being larger than the LED module and attaching with the LED module such that a bottom surface of the LED module faces the attachment side. The connector includes a housing fixed to the base, wherein the housing includes a cylindrical section with a conductor receiving passageway at a tip thereof to which the cylindrical section penetrates the base from the attachment side therethrough, and a contact having one end that connects to the conductor pattern and extends inside the cylindrical section for connection with an electrical wire insertable into the cylindrical section.

BRIEF DESCRIPTION OF THE DRAWINGS

An exemplary embodiment of the present invention will be described with reference to the drawings, of which.

DETAILED DESCRIPTION OF THE EMBODIMENT(S)

Figure 1:
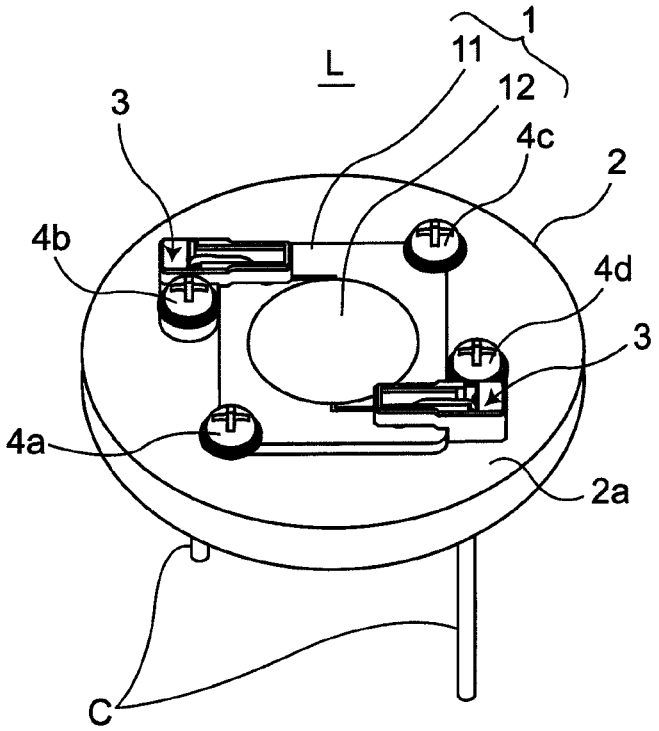
FIG. 1 is a perspective view from above of an LED connector assembly according to the invention.
Figure 2:
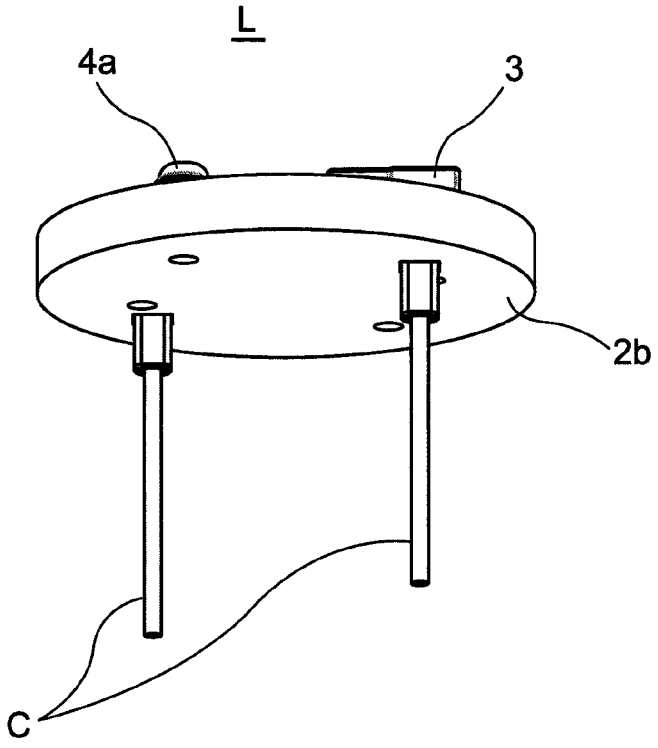
FIG. 2 is a perspective view from below showing the LED connector assembly according to the invention.
Figure 3:
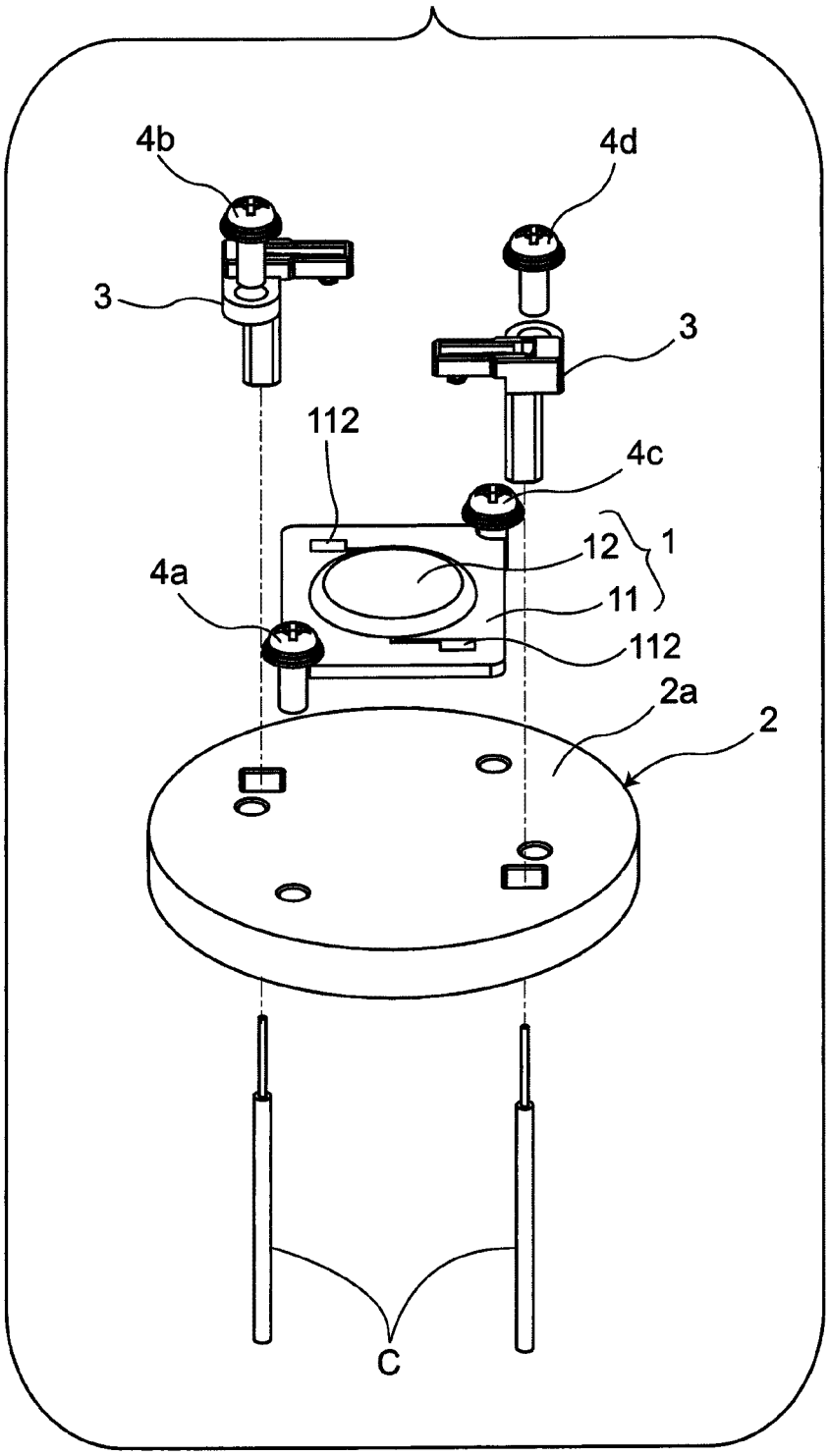
FIG. 3 is an exploded perspective view of the LED connector assembly shown in FIG. 1.

An LED connector assembly L shown in FIGS. 1 to 3 is a component to be incorporated in an LED lamp which is not shown. The LED connector assembly L includes an LED module 1, a base 2, two connectors 3 and four screws 4 (4*a*, 4*b*, 4*c*, 4*d*). Incidentally, FIGS. 1 to 3 also shown two electrical wires C to supply electrical power to the LED connector assembly L.

The LED module 1 includes a substrate 11 and an LED device 12 which is disposed on a top surface of the substrate 11. Two conductor patterns connecting to the LED device 12 are disposed on the top surface of the substrate, as shown in FIG. 3.

In the embodiment shown, the substrate 11 of the LED module 1 is a plate having a rectangular shape with notches at two corners thereof opposing to each other. The substrate 11 is formed of, for example, ceramic or aluminum having an insulating film formed thereon. The LED module 1 shown in the figures is a so-called COB (chip on board), and has a configuration in which the LED device 12 is sealed with a transparent resin in a center portion on the top surface of the substrate 11. Such an LED module 1 may be referred to as an LED package. The two conductor patterns are arranged on both sides across the LED device 12 therebetween. The two conductor patterns 13 are an anode electrode and a cathode electrode thereof, respectively, to which direct current (DC) is supplied.

Incidentally, for the substrate and the LED device of the LED module 1, a shape and an arrangement other than those described above may be adopted. For example, a configuration for the LED module, in which a surface-mount type LED package is soldered on a substrate, may be adopted.

The base 2 has an attachment side 2*a* (see, FIG. 3) being larger than the LED module 1. The LED module 1 is attached to the attachment side 2*a*. The LED module 1 is fixed to the base 2 by two screws 4*a* and 4*c* arranged at corner notches of the substrate 11. The LED module 1 is attached such that a bottom surface opposite to a top surface on which the LED device 12 is arranged faces the attachment side 2*a*. The attachment side on which the LED module 1 is arranged is a light distribution surface of the LED connector assembly L. When the LED connector assembly L is incorporated in a lamp which is not shown, this light distribution surface may be covered by a light transmissive cover.

The base 2 is formed, for example, from materials such as aluminum and a ceramic material. The base 2 also functions as a heat sink to conduct and dissipate heat from the LED module 1. The base 2 shown in FIG. 3 has a disk shape but a shape other than the disk shape may be adopted. For example, a shape in which a cooling fin is provided on a side opposite to the attachment side 2*a* in order to increase heat dissipation performance.

The two connectors 3 electrically connect the LED module 1 and the electrical wires C. Each are separate from each other, and it is possible to support various sizes of LED modules by changing an arrangement distance between the two connectors 3.

Figure 4:
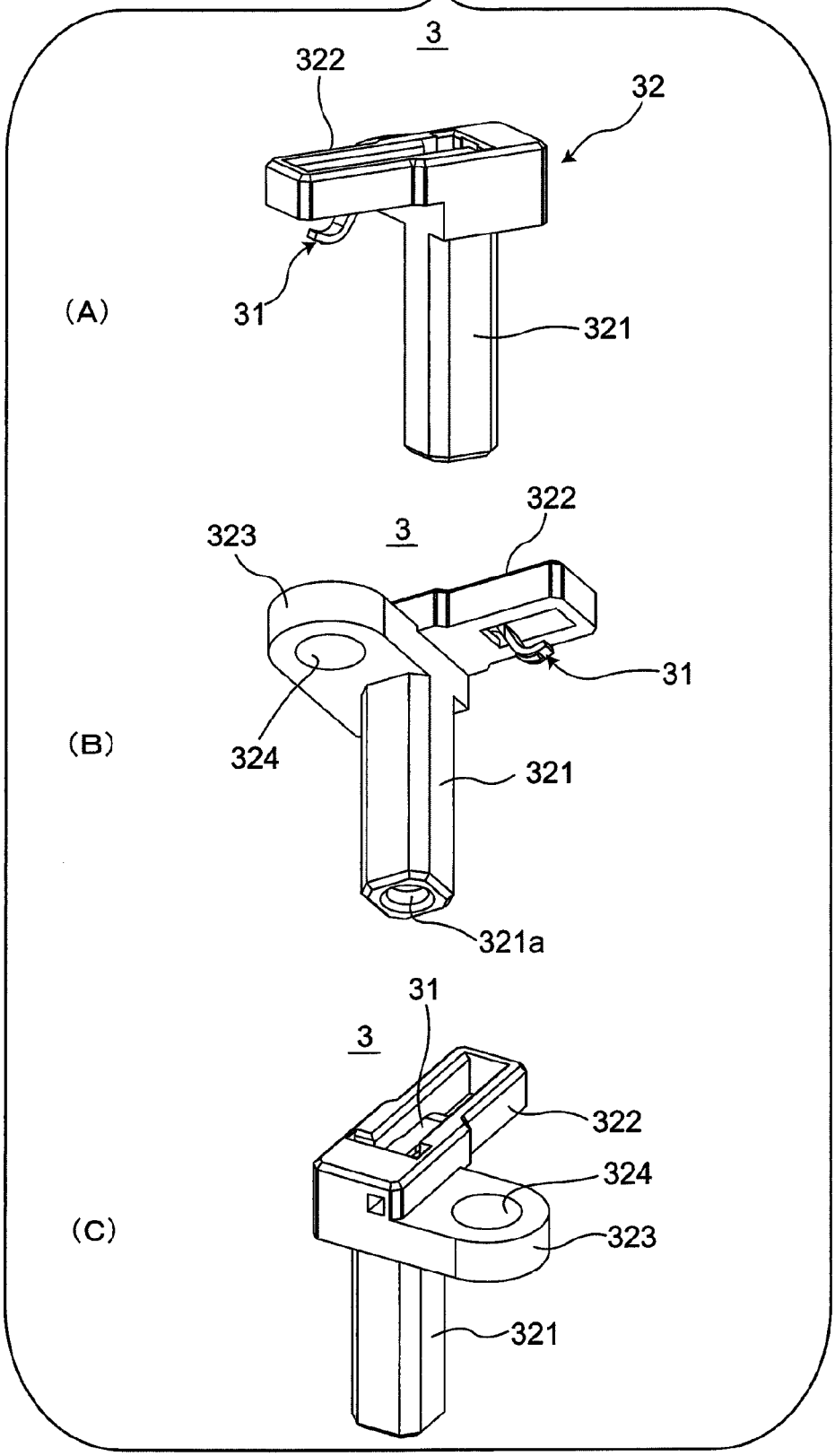
FIG. 4A is a front perspective view of a connector of the LED connector assembly shown in FIG. 1.
FIG. 4B is a bottom perspective view of the connector of the LED connector assembly shown in FIG. 1.
FIG. 4C is a rear perspective view of the connector of the LED connector assembly shown in FIG. 1
Figure 5:
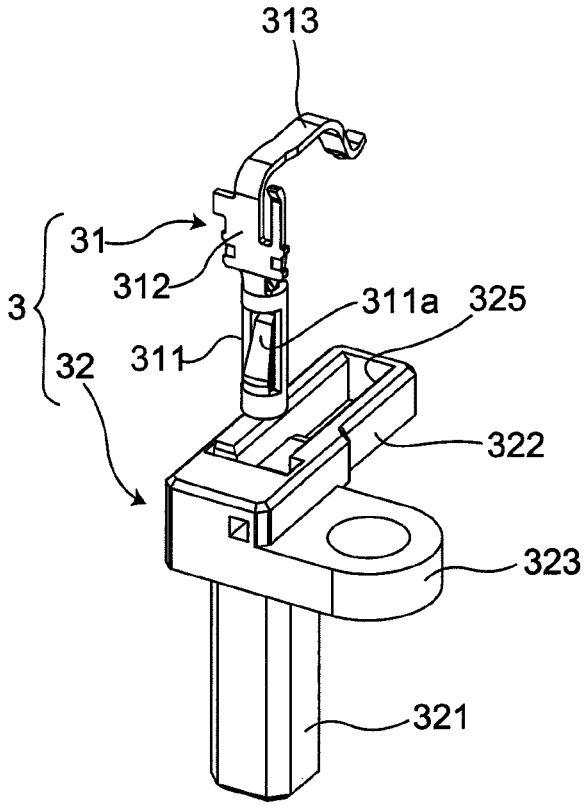
FIG. 5 is an exploded perspective view of the connector shown in FIGS. 4A-4C.

FIGS. 4A-4C are perspective exploded views of an external appearance of the connector 3 shown in FIG. 1, while FIG. 5 is an exploded perspective view of the connector 3 shown in FIG. 4. Each connector 3 has a contact 31 serving as an electrical connection and an insulating housing 32 to house the contact 31. The contact 31 is press-fitted in the insulating housing 32.

The insulating housing 32 includes a cylindrical section 321 extending downward, and an arm section 322 extending perpendicularly from one end of the cylindrical section 321. The insulating housing 32 has an L-shape consisting of the cylindrical section 321 and the arm section 322. A conductor receiving passageway 321*a* (see FIG. 4B) is formed in a bottom end of the cylindrical section 321. A groove passageway 324 continuing to a path in the cylindrical section 321 is provided in the arm section 322. In addition, a fastener section 323 to be attached to the base 2 is also provided in the insulating housing 32. A fastener receiving through which the screw 4 penetrates is provided in the fastener section 323. The insulating housing 32 is formed of an insulative material, and formed integrally with the cylindrical section 321, the arm section 322 and the fastener section 323. The fastener section 323, as shown in FIGS. 4B and 4C, is perpendicular to the arm section 322 and the cylindrical section 321. The insulating housing 32 is, as shown in FIG. 1, fixed to the base 2 by the screws 4*b* and 4*d*.

Contact 31, shown in FIG. 4, is formed by stamping and bending a metal plate. As shown in FIG. 5, the contact 31 includes an electrical wire connection section 311 to be connected with the electrical wires C, a fixed section 312 which is provided to continue to the electrical wire connection section 311 and to be fixed to the insulating housing 32, and a connection arm 313 which bends in an approximately right angle at a tip on a side opposite to the electrical wire connection section 311 of the fixed section 312 to extend and to be connected to the LED module 1. In the embodiment shown, the contact 31 has an L-shape in which the electrical wire connection section 311 and the fixed section 312 extend approximately in a line, and the connection arm 313 extends approximately at a right angle. The electrical wire connection section 311 is formed in a cylindrical shape having a size to allow a tip of the electrical wire to be inserted. A retaining lug or lance 311*a* to prevent the inserted electrical wire from being pulled out is formed in the electrical wire connection section 311.

When the contact 31 is attached in the insulating housing 32 as shown in FIG. 4, the electrical wire connection section 311 and the fixed section 312 of the contact 31 are,as shown in FIG. 5, housed in the cylindrical section 321 of the insulating housing 32. The connection arm 313 of the contact 31 is housed in the groove 325 positioned in the arm section 322 of the insulating housing 32. The fixed section 312 of the contact 31 is fixed to the insulating housing 32. A tip of the electrical wire connection section 311 of the contact 31 is exposed outside the insulating housing 32 from an opening formed in a bottom of the groove 325 of the arm section 322. The connection arm 313 which extends from the fixed section 312 serves as an elastic arm supported by the fixed section 312.

In the embodiment shown, the contact 31 serves as a so-called poke-in contact for the electrical wires C. In other words, the electrical wire connection section 311 (see FIG. 5) of the contact 31 is arranged in the cylindrical section 321 of the insulating housing 32, and the electrical wire C inserted from the conductor receiving passageway 321*a* of the cylindrical section 321 is connected to the electrical wire connection section 311. When the electrical wire C is pushed into the electrical wire connection section 311 formed in a circular cylindrical shape, the core exposed in the tip of the electrical wire C is engaged and retained by the lance 311*a*. Thus, a dedicated tool for connecting the electrical wire C is not required and so it is easy to make the connection.

Figure 6:
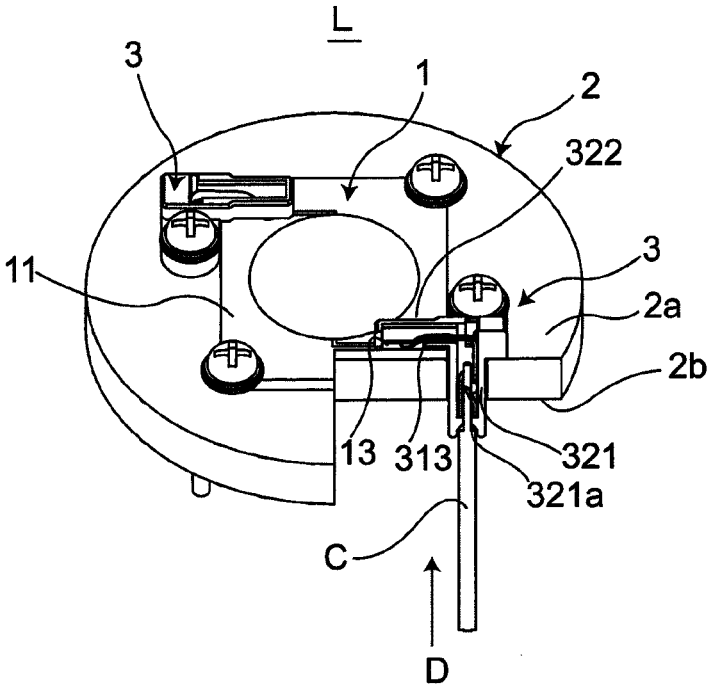
FIG. 6 is a partial cross sectional view of a connector portion of the LED connector assembly shown in FIG. 1.
Figure 7:
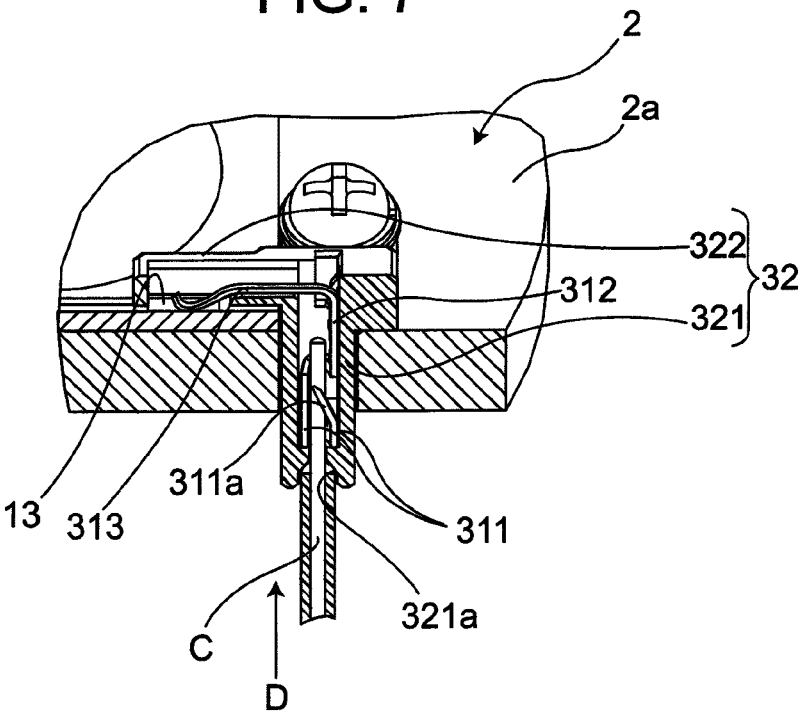
FIG. 7 is an enlarged cross sectional view showing the connector portion shown in FIG. 6.

FIG. 6 is a partial cross sectional view showing a cross section of a connector portion of the LED connector assembly shown in FIG. 1. FIG. 7 is an enlarged cross sectional view showing the connector portion shown in FIG. 6. Incidentally, in FIG. 6, for making it easy to view the detailed configuration, a hatched pattern is omitted.

As shown in FIGS. 6 and 7, the cylindrical section 321 of the insulating housing 32 included in the connector 3 penetrates the base 2 from the attachment side 2*a* of the base 2 arranged with the LED module 1. The cylindrical section 321 projects from a bottom surface 2*b* opposite to the attachment side 2*a* of the base 2 in a direction approximately perpendicular to the bottom surface 2*b*. The conductor receiving passageway 321*a* of the cylindrical section 321 is located at a tip up to which the cylindrical section 321 penetrates the base 2. In addition, the arm section 322 of the insulating housing 32 bends from the cylindrical section 321 approximately in a right angle at the attachment side 2*a* of the base 2 to extend, and arranged on the substrate 11 of the LED module 1.

The tip of the connection arm 313 in the contact 31 is connected to the conductor pattern 13. In further detail, as shown in FIGS. 6 and 7, the connection arm 313 continuing from the fixed section 312 is pressed to the conductor pattern 13 and elastically deformed so as to elastically make contact with the conductor pattern 13. The fixed section 312 and the electrical wire connection section 311 of the contact 31 are arranged side by side in the cylindrical section 321 of the insulating housing 32.

FIGS. 6 and 7 shows when the electrical wire C has been connected to the LED connector assembly L. When an LED lamp (not shown) is assembled with the LED connector assembly L of the shown embodiment, in a process of connecting the electrical wire C to the LED connector assembly L, the electrical wire C, whose sheath is removed at the tip, thereof is moved from a side of the bottom surface 2*b* of the base 2 in a direction in which an arrow D is oriented, and is inserted from the conductor receiving passageway 321*a* to the cylindrical section 321 of the insulating housing 32. By doing so, the core of the electrical wire C is connected to the electrical wire connection section 311 of the contact 31 and the electrical wire C and the LED module 1 are electrically connected with each other through the connector 3. The core of the electrical wire C connected to the electrical wire connection section 311 is hooked by the lance 311*a*, and not pulled out from the electrical wire connection section 311 even if a pulling force is applied to the electrical wire C.

The LED connector assembly L according to the shown embodiment is configured such that the cylindrical section 321 of the insulating housing 32 penetrates the base 2 from the attachment side 2*a* to extend to the tip where the conductor receiving passageway 321*a* is formed, and the contact 31 arranged in the cylindrical section 321 is connected to the electrical wire C which is inserted from the conductor receiving passageway 321*a* into the cylindrical section 321. In other words, in the LED connector assembly L, a connection portion between the electrical wire C and the contact 31 are arranged to project on the side of the bottom surface 2*b* of the base 2. In a process of connecting the electrical wire C to the LED connector assembly L, the electrical wire C is not moved in parallel with the base 2 in an area around the base 2, but moved perpendicularly toward the bottom surface 2*b* of the base 2. Therefore, the possibility of the electrical wire C contacting to the base 2, etc. while being moved is low, and thus, an operation of connecting the electrical wires C is efficient.

In addition, in the LED connector assembly L according to the shown embodiment, the electrical wire C is arranged by avoiding a side of the attachment side 2*a* which is the light distribution surface. The two electrical wires C supply direct current to the anode and the cathode of the LED, respectively, and their polarities need to be distinguished from each other. For a way to distinguish the polarities of the two electrical wires C, providing different colors for sheathes may be adopted. While one of the two electrical wires C is colored to be a color of light emitted by the LED device 12, for example, white or yellow, the other of the two electrical wires C needs to be in a color such as red or black which is different from the color of the emitted light. When these two electrical wires are arranged on the side of the attachment side 2*a* which is the light distribution surface, a shade and the color of the electrical wire may be viewed from the outside of a cover.

According to the LED connector assembly L according to the shown embodiment, since the electrical wires C are only on the side of the bottom surface 2*b* opposite to the attachment side 2*a* which is the light distribution surface, the colors and shade of the electrical wires are not viewed.

Furthermore, according to the LED connector assembly L according to the shown embodiment, the insulating housing 32 has the shape of bending approximately in a right angle from the cylindrical section 321. Therefore, the projection height on the side of the attachment side 2*a* of the connector 3 including the insulating housing 32 is reduced, and the light emitted from the LED device 12 is not disturbed so that a shade and the color do not appear.

Incidentally, in the above-described embodiment, as an example of the contact 31 connected to the conductor pattern 13 according to the present invention, the contact 31 which elastically contacts to the conductor pattern 13 is described. However, the present invention is not limited to this. The contact may be, for example, connected to the conductor pattern 13 by soldering.

In addition, in the above-described embodiment, as the LED connector assembly L of the present invention, an example in which the LED connector assembly L is incorporated in an LED lamp is described. However, the present invention is not limited to this. The LED connector assembly L may be, for example, attached directly to a lighting fixture.

When the LED connector assembly L of the present invention is connected to an electrical wire C, the electrical wire C is moved toward the base 2 from a side opposite to the side on which the LED module 1 is attached of the base 2, and inserted from the opening into the cylindrical section 321 of the housing 32. Therefore, the possibility of the electrical wire C to contact the base 2 or other components at the time of connection is avoided, and an operation of connecting the electrical wire C becomes efficient. In addition, since the electrical wire C is arranged on a side opposite to the side of the LED module 1, a color and a shade of the electrical wire C do not appear when the LED device emits light.

The contact 31 of the present invention is provided in the LED connector assembly L. And thus, when the LED connector assembly L is connected to an electrical wire C, since the electrical wire C is moved not along the base 2 but toward the base 2 to be connected, an operation of connecting the electrical wire C becomes efficient.

As described above, according to the present invention, an LED connector assembly L in which an electrical wire C connection operation is efficient is obtained.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A light emitting diode ("LED") connector assembly, comprising:

an LED module having (1) a substrate provided with a conductor pattern and (2) an LED device disposed on a surface of the substrate connecting to the conductor pattern;

a base having an attachment side that attaches with the LED module such that a bottom surface of the LED module faces the attachment side, and a bottom side positioned opposite the attachment side, the attachment side having a surface area which is larger than a surface area of the bottom side; and a connector that includes a housing fixed to the base and having (1) a cylindrical section with a conductor receiving passageway at a tip thereof to which the cylindrical section penetrates the base from the attachment side, extending through the base and projecting outward from the bottom side, and (2) a contact having one end that connects to the conductor pattern and extends inside the cylindrical section for connection with an electrical wire insertable into the cylindrical section.

2. The LED connector assembly according to claim 1, wherein the contact includes a lance.

3. The LED connector assembly according to claim 2, wherein the housing has an L-shape bend.

4. The LED connector assembly according to claim 3, wherein the contact bends in accordance with a shape of the housing on the side of the attachment side.

5. The LED connector assembly according to claim 4, wherein the contact includes a tip positioned beyond where the contact bends to be connected with a conductor on the substrate.

6. The LED connector assembly according to claim 1, wherein the connector further includes a fastener section attached to the base by a fastener that penetrates through the fastener section and secures to the base.

7. A connector for an LED connector assembly, the connector comprising:

a longitudinally extending cylindrical section with a conductor receiving passageway at a tip thereof;

a longitudinally extending arm section having a groove and bending from a first end of the longitudinally extending cylindrical section to extend perpendicularly away therefrom; and a contact having one end that extends into the groove of the arm section and another end that extends inside the cylindrical section for connection with an electrical wire insertable into the cylindrical section.

8. The connector according to claim 7, wherein the contact includes a lance.

9. The connector according to claim 8, wherein a tip of the contact bends downward from the groove for contact with a conductor on the LED connector assembly.

10. The connector according to claim 9, further comprising a fastener section attached and extending perpendicularly away from both the longitudinally extending arm section and the longitudinally extending cylindrical section.

11. The connector according to claim 10, wherein the fastener section includes a fastener receiving passageway for accepting a fastener that penatrates there through and secures to a base of the LED connector assembly.

* * * * *